US011535490B2

(12) United States Patent
Kuenzi et al.

(10) Patent No.: US 11,535,490 B2
(45) Date of Patent: Dec. 27, 2022

(54) SYSTEM AND METHOD FOR CALLING ELEVATOR

(71) Applicant: Carrier Corporation, Palm Beach Gardens, FL (US)

(72) Inventors: Adam Kuenzi, Silverton, OR (US); Bradley Armand Scoville, Farmington, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 643 days.

(21) Appl. No.: 16/611,267

(22) PCT Filed: May 3, 2018

(86) PCT No.: PCT/US2018/030808
§ 371 (c)(1),
(2) Date: Nov. 6, 2019

(87) PCT Pub. No.: WO2018/213008
PCT Pub. Date: Nov. 22, 2018

(65) Prior Publication Data

US 2020/0165099 A1 May 28, 2020

Related U.S. Application Data

(60) Provisional application No. 62/508,165, filed on May 18, 2017.

(51) Int. Cl.
*B66B 1/16* (2006.01)
*B66B 1/46* (2006.01)
*B66B 1/34* (2006.01)

(52) U.S. Cl.
CPC ..... *B66B 1/468* (2013.01); *B66B 1/3461* (2013.01); *B66B 2201/4615* (2013.01); *B66B 2201/4653* (2013.01)

(58) Field of Classification Search
CPC ..... B66B 1/468; B66B 1/3461; B66B 2201/4615; B66B 2201/4653
(Continued)

(56) References Cited

U.S. PATENT DOCUMENTS 4,685,538 A 8/1987 Kamaike
5,689,094 A 11/1997 Friedli et al.
(Continued)

FOREIGN PATENT DOCUMENTS

EP 2290939 A1 * 3/2011 ..... B66B 1/468
EP 2848569 A1 3/2015
(Continued)

OTHER PUBLICATIONS

Notification of Transmittal of the International Search Report of International Application No. PCT/US2018/030808; dated Aug. 10, 2018; Report; 6 pages.
(Continued)

*Primary Examiner* — Mahendra R Patel
(74) *Attorney, Agent, or Firm* — Souad Hakim

(57) ABSTRACT

A method of calling an elevator is provided. The method comprising: detecting, using a door lock, at least one status parameter of a door and the door lock operably associated with the door; transmitting, using the door lock, the at least one status parameter to a remote device; determining, using the remote device, whether to call an elevator in response to the at least one status parameter; transmitting, using the remote device, an elevator call request to a controller when it is determined to call an elevator; and moving, using the controller, an elevator to a floor where the door lock is located.

16 Claims, 4 Drawing Sheets

(58) Field of Classification Search
USPC ..... 187/380
See application file for complete search history.

(56) References Cited

U.S. PATENT DOCUMENTS 6,382,363 B1 * 5/2002 Friedli ..... B66B 1/468 187/392
6,397,976 B1 * 6/2002 Hale ..... B66B 1/2408 187/389
8,791,790 B2 * 7/2014 Robertson ..... G07C 9/20 455/411
9,382,095 B2 * 7/2016 Rusanen ..... B66B 1/468
2008/0196979 A1 * 8/2008 Sakurai ..... B66B 1/2408 187/389
2009/0133969 A1 * 5/2009 Zaharia ..... G07C 9/20 455/411
2014/0339023 A1 * 11/2014 Friedli ..... B66B 1/2408 187/247
2015/0251874 A1 * 9/2015 Salmikuukka ..... B66B 1/2408 187/380
2016/0035160 A1 2/2016 Friedli
2016/0035161 A1 * 2/2016 Friedli ..... B66B 1/468 187/392
2016/0090271 A1 * 3/2016 Silvennoinen ..... B66B 1/468
2018/0282117 A1 * 10/2018 Baldi ..... B66B 1/2408 187/380

FOREIGN PATENT DOCUMENTS

WO WO-2004035449 A1 * 4/2004 ..... B66B 1/34
WO WO-2007066390 A1 * 6/2007 ..... B66B 1/2458
WO WO-2008110241 A2 * 9/2008 ..... B66B 1/2458
WO 2008116963 A1 10/2008
WO WO-2008116963 A1 * 10/2008 ..... B66B 1/2458
WO 2013033879 A1 3/2013
WO WO-2015015049 A1 * 2/2015 ..... B66B 1/468
WO 2015036653 A1 3/2015
WO WO-2015036653 A1 * 3/2015 ..... B66B 1/468
WO 2016198548 A1 12/2016

OTHER PUBLICATIONS

Written Opinion of the International Searching Authority of International Application No. PCT/US2018/030808; dated Aug. 10, 2018; Report; 6 pages.

* cited by examiner

SYSTEM AND METHOD FOR CALLING ELEVATOR

CROSS-REFERENCE TO RELATED APPLICATIONS

This application is a National Stage of International Application No. PCT/US2018/030808 filed May 3, 2018, which claims priority to U.S. Provisional Patent Application Ser. No. 62/508,165 filed May 18, 2017, both of which are incorporated herein by reference in their entirety.

BACKGROUND

The subject matter disclosed herein generally relates to the field of elevator controls, and more particularly to an apparatus and method for call an elevator.

Existing elevator controls require persons to walk over to the elevator and press an elevator call button to call an elevator. This process typically includes a long wait time before the elevator arrives at the floor after it was called.

BRIEF SUMMARY

According to one embodiment, a method of calling an elevator is provided. The method comprising: detecting, using a door lock, at least one status parameter of a door and the door lock operably associated with the door; transmitting, using the door lock, the at least one status parameter to a remote device; determining, using the remote device, whether to call an elevator in response to the at least one status parameter; transmitting, using the remote device, an elevator call request to a controller when it is determined to call an elevator; and moving, using the controller, an elevator to a floor where the door lock is located.

In addition to one or more of the features described above, or as an alternative, further embodiments of the method may include: determining, using the remote device, an estimated time of arrival in response to the at least one status parameter; and adjusting, using the controller, movement of the elevator in response to the estimated time of arrival.

In addition to one or more of the features described above, or as an alternative, further embodiments of the method may include where the at least one status parameter comprises: a door status parameter depicting whether the door is open or closed; and a lock status parameter depicting whether the door lock is engaged or disengaged.

In addition to one or more of the features described above, or as an alternative, further embodiments of the method may include wherein: the door status parameter further depicts a period of time that the door is opened or closed; and the lock status parameter further depicts a period of time that the door lock is engaged or disengaged.

In addition to one or more of the features described above, or as an alternative, further embodiments of the method may include where the remote device is a user mobile device.

In addition to one or more of the features described above, or as an alternative, further embodiments of the method may include where the at least one status parameter comprises: a door status parameter depicting whether the door is open or closed; and a lock status parameter depicting whether the door lock is engaged or disengaged.

In addition to one or more of the features described above, or as an alternative, further embodiments of the method may include where the door status parameter further depicts a period of time that the door is opened or closed; and the lock status parameter further depicts a period of time that the door lock is engaged or disengaged.

In addition to one or more of the features described above, or as an alternative, further embodiments of the method may include: detecting a distance parameter between the user mobile device and the door lock; and verifying the determination to call an elevator in response to the distance parameter.

In addition to one or more of the features described above, or as an alternative, further embodiments of the method may include determining an estimated time of arrival in response to the at least one status parameter and distance parameter; and adjusting movement of the elevator in response to the estimated time of arrival.

In addition to one or more of the features described above, or as an alternative, further embodiments of the method may include: detecting a motion parameter of the user mobile device; and verifying the determination to call an elevator in response to the motion parameter.

In addition to one or more of the features described above, or as an alternative, further embodiments of the method may include: determining an estimated time of arrival in response to the at least one status parameter and motion parameter; and adjusting movement of the elevator in response to the estimated time of arrival.

In addition to one or more of the features described above, or as an alternative, further embodiments of the method may include: generating a pop-up through a user interface on the user mobile device when the user mobile device determines to call elevator; receiving a user input through the user interface; and verifying the determination to call an elevator in response to the user input.

In addition to one or more of the features described above, or as an alternative, further embodiments of the method may include where the remote device is a second door lock.

In addition to one or more of the features described above, or as an alternative, further embodiments of the method may include: determining, using the remote device, a destination floor for the elevator, wherein destination floor is determined in response to at least one of a previous elevator call request, a time-of-day, and a selected schedule; and transmitting, using the remote device, the destination floor to the elevator.

According to another embodiment, an elevator call system is provided. The elevator call system comprising: a remote device application in communication with a door lock, the remote device application receives at least one status parameter from said door lock and determines whether to transmit an elevator call request in response to the at least one status parameter; and a controller in communication with the remote device application, the controller receives an elevator call request.

In addition to one or more of the features described above, or as an alternative, further embodiments of the elevator call system may include where: the remote device application determines an estimated time of arrival in response to the at least one status parameter; and the controller adjusts movement of an elevator in response to the estimated time of arrival.

In addition to one or more of the features described above, or as an alternative, further embodiments of the elevator call system may include where the at least one status parameter comprises: a door status parameter depicting whether the door is open or closed; and a lock status parameter depicting whether the door lock is engaged or disengaged.

In addition to one or more of the features described above, or as an alternative, further embodiments of the elevator call system may include where the door status parameter further depicts a period of time that the door is opened or closed; and the lock status parameter further depicts a period of time that the door lock is engaged or disengaged.

In addition to one or more of the features described above, or as an alternative, further embodiments of the elevator call system may include where the remote device application is on a user mobile device.

In addition to one or more of the features described above, or as an alternative, further embodiments of the elevator call system may include where the at least one status parameter comprises: a door status parameter depicting whether the door is open or closed; and a lock status parameter depicting whether the door lock is engaged or disengaged.

Technical effects of embodiments of the present disclosure include door lock in communication with a controller to determine when to call an elevator.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION

The following descriptions should not be considered limiting in any way. With reference to the accompanying drawings, like elements are numbered alike:

DETAILED DESCRIPTION

A detailed description of one or more embodiments of the disclosed apparatus and method are presented herein by way of exemplification and not limitation with reference to the Figures.

Figure 1:
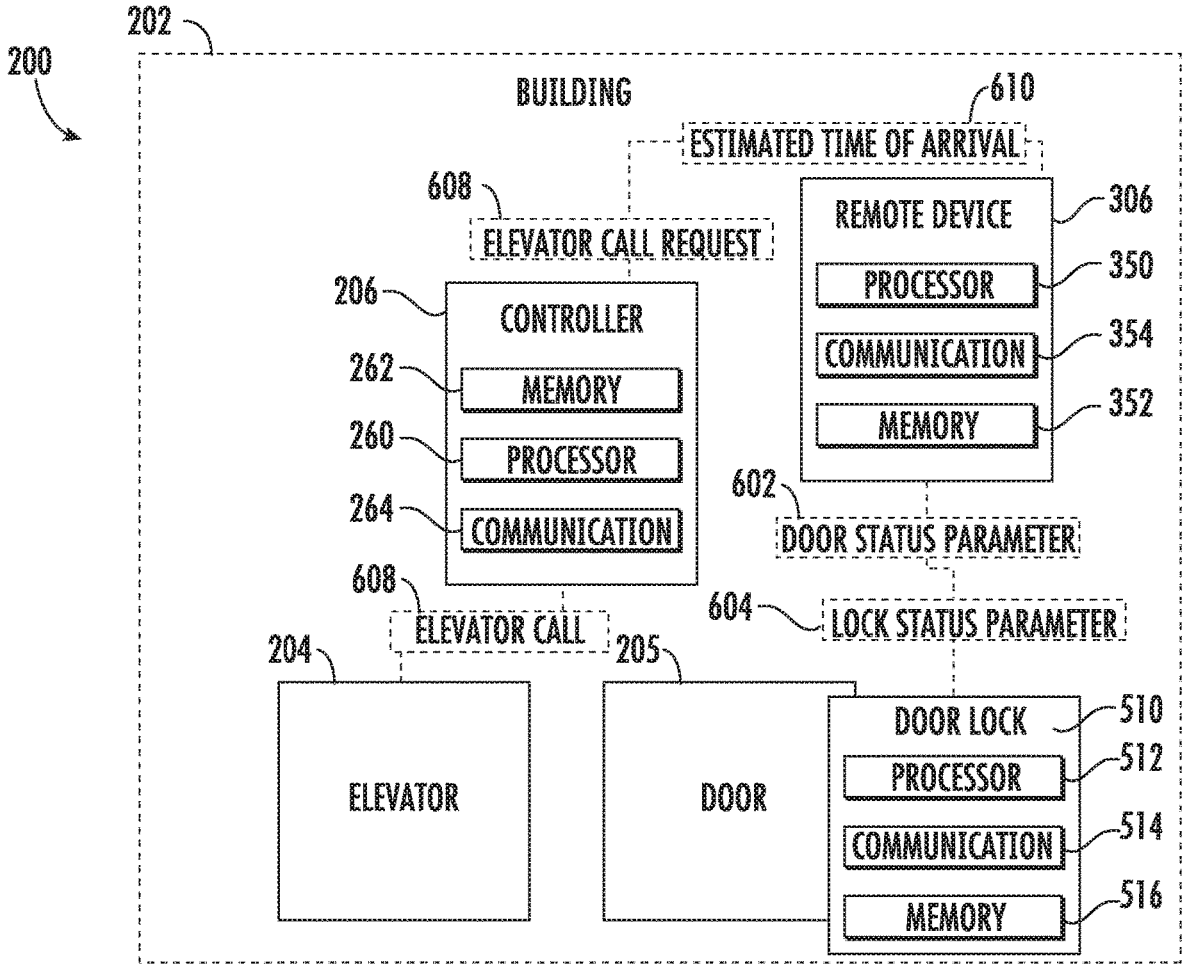
FIG. 1 illustrates a schematic view of an elevator call system, in accordance with an embodiment of the disclosure.
Figure 2:
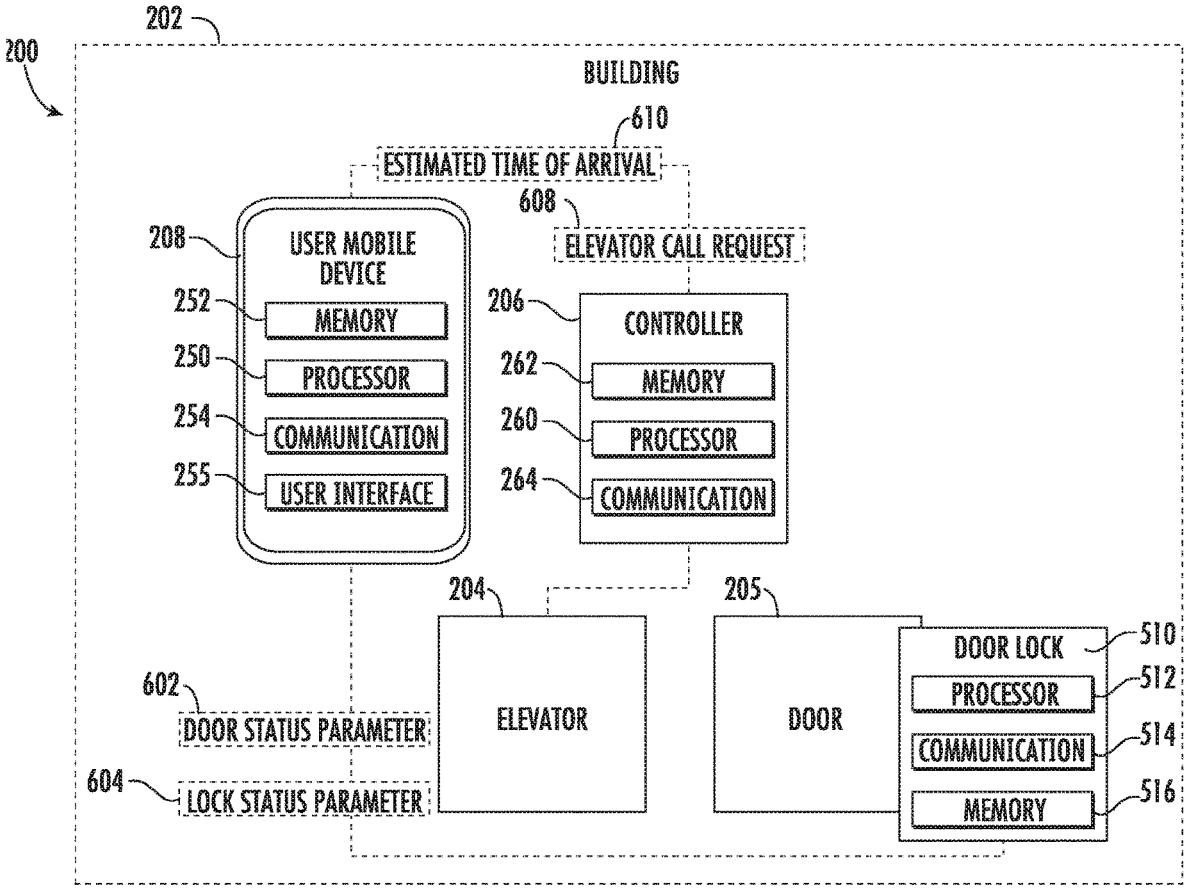
FIG. 2 illustrates a schematic view of an elevator call system, in accordance with an embodiment of the disclosure.

Referring to FIGS. 1 and 2, which depict an elevator call system 200 in example embodiments. As seen in FIG. 1, the elevator call system 200 includes a door lock 510, a controller 206, and a remote device 306. Whereas in FIG. 2, the remote device 306 is replaced by user mobile device 208, thus in an embodiment, the remote device 306 is a user mobile device 208. The elevator call system 200 includes at least one elevator 204 installed at a building 202. In some embodiments, the building 202 may be a building or a collection of buildings that may or may not be physically located near each other. The building 202 may include any number of floors. Persons entering the building 202 may enter at a lobby floor, or any other floor, and may go to a destination floor via one or more conveyance devices, such as the elevator 204.

The elevator 204 may be operably connected to one or more controllers 206. The controller 206 may be configured to control dispatching operations for one or more elevator 204. It is understood that the elevator 204 may utilize more than one controller 206, and that each controller may control a group of elevators 204. Although one elevator 204 is shown in FIG. 1, it is understood that any number of elevators 204 may be used in the elevator call system 200. The elevators 204 may be located in the same hoistway or in different hoistways so as to allow coordination amongst elevators 204 in different elevator banks serving different floors. It is understood that other components of the elevator 204 (e.g., elevator car, doors, drive, counterweight, safeties, etc.) are not depicted for ease of illustration.

Persons entering the building 202 may be required to enter a door 205. Persons leaving apartments and/or offices may be required to exit through a door 205. The door 205 may include but is not limited to a door in a wall of the building 202, a door on the outside of the building 202, a garage door, a parking lot access gate, a turnstile, a car door, or similar access point known to one of skill in the art. Although only one door 205 is shown in FIG. 1, it is understood that any number of doors 205 may be used in the elevator call system 200. The one or more doors 205 may be located either inside the building 202 or outside the building 202. Each door 205 may contain a door lock 510 configured to lock/unlock the door 205. Further, it is understood that other components of doors 205 are not depicted for ease of illustration. In a non-limiting example, the door lock 510 may be a dead bolt lock, such as, for example a privacy lock on a hotel door. The privacy lock may be only locked from the inside of a room and may only be unlocked from the outside by a master key. The door lock 510 may include a processor 512, memory 516 and communication module 514 as shown in FIG. 1. The processor 512 can be any type or combination of computer processors, such as a microprocessor, microcontroller, digital signal processor, application specific integrated circuit, programmable logic device, and/or field programmable gate array. The memory 516 is an example of a non-transitory computer readable storage medium tangibly embodied in the door lock 510 including executable instructions stored therein, for instance, as firmware. The communication module 514 may implement one or more communication protocols as described in further detail herein. The door lock 510 may communicate with remote device 306 and/or the user mobile device 208.

As mentioned above, the controller 206 is configured to control the operation of one or more elevators 204. The controller 206 may include a processor 260, memory 262 and communication module 264 as shown in FIG. 1. The processor 260 can be any type or combination of computer processors, such as a microprocessor, microcontroller, digital signal processor, application specific integrated circuit, programmable logic device, and/or field programmable gate array. The memory 262 is an example of a non-transitory computer readable storage medium tangibly embodied in the controller 206 including executable instructions stored therein, for instance, as firmware. The communication module 264 may implement one or more communication protocols as described in further detail herein. The controller 206 may communicate through the communication module 264 to the remote device 306, the user mobile device 208, and/or the elevator 204. In a non-limiting embodiment, the controller 206 may be hardwired to the elevator 204 and/or the remote device 306.

Referring now to FIG. 1, which shows a remote device 306. The remote device 306 is configured to communicate with the door lock 510 and the controller 206. The remote device 306 may include a processor 350, memory 352 and communication module 354 as shown in FIG. 1. The processor 350 can be any type or combination of computer processors, such as a microprocessor, microcontroller, digital signal processor, application specific integrated circuit, programmable logic device, and/or field programmable gate array. The memory 352 is an example of a non-transitory computer readable storage medium tangibly embodied in or operably connected to the authorization service including executable instructions stored therein, for instance, as firmware. The communication module 354 may implement one or more communication protocols as described in further detail herein. The remote device 306 may communicate through the communication module 354 to the controller and/or the door lock 510. In a non-limiting example the remote device 306 may be located in the hall ways of a building 202. In embodiment, the remote device 306 may be another door lock 510.

The door lock 510 and the remote device 306 communicate with one another. The door lock 510 and the remote device 306 may communicate over a wireless network, such as 802.11x (WiFi), short-range radio (Bluetooth), cellular, satellite, etc. In some embodiments, the remote device 306 may include, or be associated with (e.g., communicatively coupled to) a networked element, such as kiosk, beacon, lantern, bridge, router, network node, building intercom system, thermostat, set top box, etc. The networked element may communicate with the door lock 510 using one or more communication protocols or standards. In other embodiments, the door lock 510 may establish communication with a remote device 306 that is not associated with a networked element in the building 202. In example embodiments, the door lock 510 communicates with the remote device 306 over multiple independent wired and/or wireless networks. Embodiments are intended to cover a wide variety of types of communication between the door lock 510 and the remote device 306 and embodiments are not limited to the examples provided in this disclosure.

Figure 3:
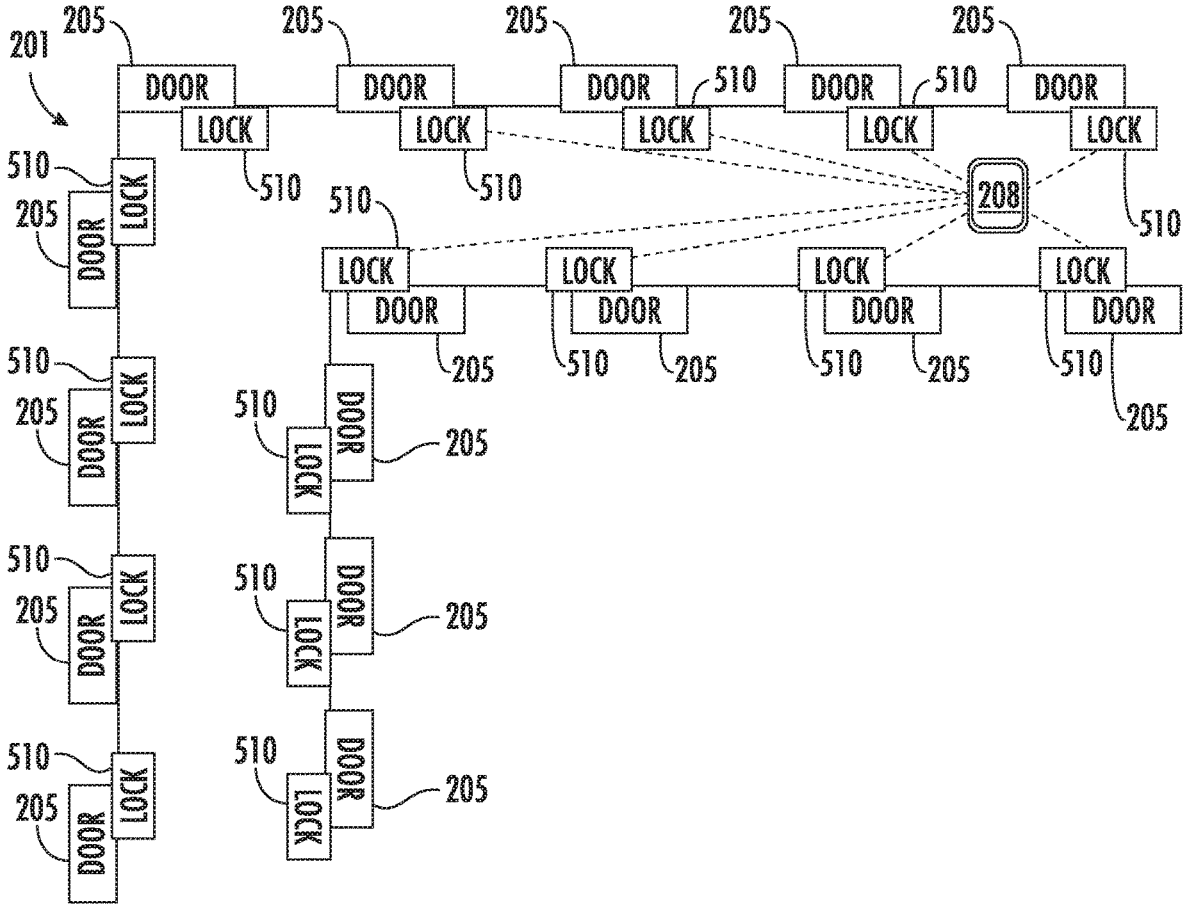
FIG. 3 illustrates a schematic view of an elevator call system, in accordance with an embodiment of the disclosure.

The door lock 510 is configured to communicate status parameters to the remote device 306 (user mobile device 208 in FIG. 3). The status parameters may include a door status parameter 602 and a lock status parameters 604. The door status parameter 602 may depict whether the door 205 is open/closed. The lock status parameter 604 may depict whether the door lock 510 is engaged/disengaged. The remote device 306 evaluates these status parameters 602, 604 and determines whether a person is on their way to an elevator 204 in response to the status parameters 602, 604. For example, if the door 205 has opened then closed and the door lock 510 (e.g. a privacy lock on a hotel room) has not been engaged, it may indicate that a person is leaving their hotel room and is on their way to an elevator bank. Conversely, if the door 205 has opened then closed and the door lock 510 (e.g. a privacy lock on a hotel room) is engaged, it may indicate that a person has not left the room considering the privacy lock may need to be engaged from the inside.

If the remote device 306 has determined that the person is on their way to an elevator bank to get an elevator 204 then the remote device 306 will transmit an elevator call request 608 to the controller 206 and the controller 206 will call an elevator 204. In another embodiment, the remote device 306 may determine an estimated time of arrival 610 of the person at the elevator bank and transmit the estimated time of arrival 610 to the controller 206. The controller 206 may utilize the estimated time of arrival 610 to time the elevator call 608 so that an elevator 204 will arrive at about the same time the person arrives at the elevator bank. In one non-limiting example, the estimated time of arrival 610 may be based on average walking speed and/or preprogrammed distance of the location of the remote device 306 relative to the location of the elevator bank.

Referring now to FIG. 2, which shows a user mobile device 208. In the embodiment shown in FIG. 2, the user mobile device 208 is the remote device 306. The user mobile device 208 may be a mobile computing device that is typically carried by a person, such as, for example a phone, PDA, smart watch, tablet, laptop, etc. The user mobile device 208 may include a processor 250, memory 252 and communication module 254 as shown in FIG. 1. The processor 250 can be any type or combination of computer processors, such as a microprocessor, microcontroller, digital signal processor, application specific integrated circuit, programmable logic device, and/or field programmable gate array. The memory 252 is an example of a non-transitory computer readable storage medium tangibly embodied in the user mobile device 208 including executable instructions stored therein, for instance, as firmware. The communication module 254 may implement one or more communication protocols as described in further detail herein. The user mobile device 208 may communicate through the communication module 254 to the controller and/or the door lock 510. In a non-limiting example, the user mobile device 208 may belong to an employee and/or resident of the building 202.

The door lock 510 and the user mobile device 208 communicate with one another. The door lock 510 and the user mobile device 208 may communicate over a wireless network, such as 802.11x (WiFi), short-range radio (Bluetooth), cellular, satellite, etc. In example embodiments, the door lock 510 communicates with the user mobile device 208 over multiple wireless networks. Embodiments are intended to cover a wide variety of types of communication between the door lock 510 and the user mobile device 208 and embodiments are not limited to the examples provided in this disclosure.

The door lock 510 is configured to communicate status parameters 602, 604. The status parameters may include a door status parameter 602 and a lock status parameters 604. The door status parameter 602 may depict whether the door 205 is open/closed. The lock status parameter 604 may depict whether the door lock 510 is engaged/disengaged. The user mobile device 208 evaluates these status parameters 602, 604 and determines whether a person is on their way to an elevator 204 in response to the status parameters 602, 604. For example, if the door 205 has opened then closed and the door lock 510 (e.g. a privacy lock on a hotel room) has not been engaged, it may indicate that a person is leaving their hotel room and is on their way to an elevator bank. Conversely, if the door 205 has opened then closed and the door lock 510 (e.g. a privacy lock on a hotel room) is engaged, it may indicate that a person has not left the room considering the privacy lock may need to be engaged from the inside.

The user mobile device 208 may also determine that a person is heading to the elevator bank by detecting a distance parameter, which is the distance between the user mobile device 208 and a door lock 510. In an example, the distance parameter may be determined by the received signal strength of a radio signal by the communications module 254 during communication between the mobile device 208 and the door lock 510. Other methods of determining distance may include indoor location systems or the like. In an example, if the user mobile device 208 is moving away from the door lock 510 that may indicate that the person is heading towards the elevator bank. The user mobile device 208 may use the distance parameter alone and/or in combination with the status parameters 602, 604 to determine that a person is on their way to an elevator bank to get an elevator.

If the user mobile device 208 has determined that the person is on their way to an elevator bank to get an elevator 204 then the user mobile device 208 may request confirmation on the user mobile device 208 or automatically transmit an elevator call request 608 to the controller 206 and the controller 206 will call an elevator 204. The user mobile device 208 may request confirmation through a pop-up within a user interface 255 of the user mobile device 208. In the pop-up on the user mobile device 208 may request for a person to confirm that they are actually heading to the elevator bank prior to transmitting an elevator call request 608. Additionally, if the mobile device 208 determines they are not actually heading to the elevator bank an elevator call request 608 may be sent that cancels a previous request. In another embodiment, the user mobile device 208 may determine an estimated time of arrival 610 of the person at the elevator bank and transmit the estimated time of arrival 610 to the controller 206. The controller 206 may utilize the estimated time of arrival 610 to schedule the elevator call request 608 so that an elevator 204 will arrive at about the same time the person arrives at the elevator bank. In one non-limiting example, the estimated time of arrival 610 may be based on average walking speed. In another non-limiting example, the user mobile device 208 may use an accelerometer within the user mobile device 208 to determine walking speed and adjust the estimated time of arrival 610. In another non-limiting example, the user mobile device 208 may use GPS and/or any similar location determination system to determine walking speed. In another non-limiting example, the remote device 306 (which may be mobile device 208 in some embodiments) may determine the destination floor as part of the elevator call request 608. The destination floor may be determined in numerous ways including but not limited to: by previous elevator call requests (i.e. go to the same floor the requested before); by the time-of-day (at this time they usually go up; at that time they usually go down or to some floor); by the user selecting a destination floor as part of the pop-up on user interface 255 of the mobile device 208; or by a selected schedule (at this time go here, at that time go there) or by a default floor setting (always select this floor). Further to this non-limiting example, the controller 206 would respond to the call request 608 by bringing the elevator 204 to the floor and pre-selecting the destination for the user.

Referring now to FIG. 3, the user mobile device 208 may also determine whether a person is heading to an elevator bank through communicating with multiple locks 510 located on each door 205 in a hall way 201 of the building 202. When the user mobile device 208 is within selected distance of a door lock 510, the user mobile device 208 may be able to communicate with the door lock 510. The user mobile device 208 may be able to determine a distance away from a door lock 510 using signal strength. Further, through communication with a door lock 510, the door lock 510 may transmit its location in the hallway 201 and building to the user mobile device 208. Using the location of each nearby door lock 510 and signal strength, the user mobile device 208 may be able to determine its location. Once location of the user mobile device 208 is known, more information may be determined, such as for example, direction that the user mobile device 208 is traveling and speed that the user mobile device 208 is traveling. The location, speed, and direction of the user mobile device 208 may further help the user mobile device 208 determine whether the person holding the user mobile device 208 is heading towards and elevator bank and the estimated time of arrival 610.

Embodiments disclosed herein, may operate through a remote device application installed on the remote device 306 and/or the user mobile device 208. In an embodiment, the controller 206 is in communication with the remote device application.

Figure 4:
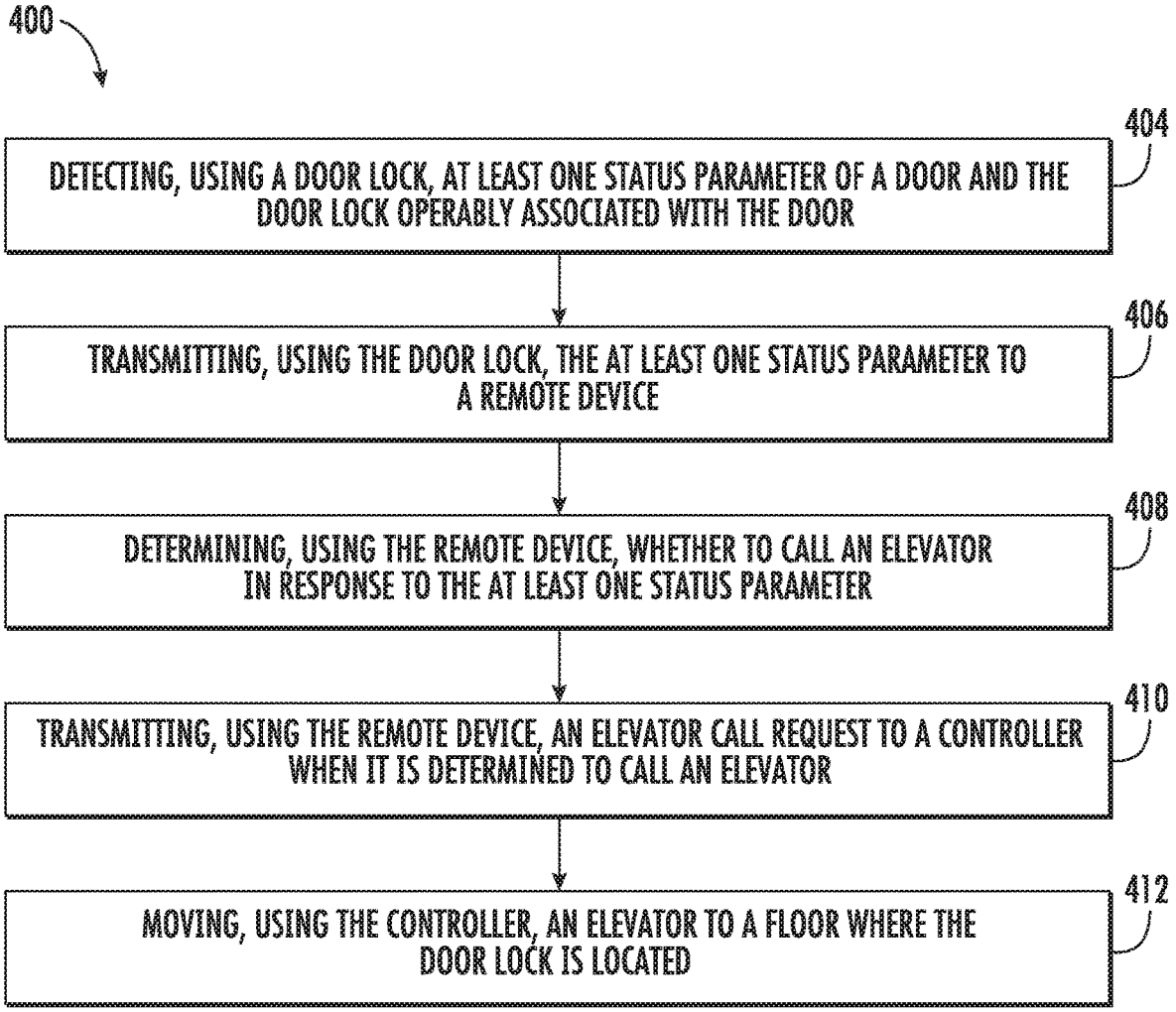
FIG. 4 is a flow diagram illustrating a method of controlling access to at least one access point, according to an embodiment of the present disclosure.

Referring now to FIG. 4, while referencing components of FIGS. 1-3. FIG. 4 shows a flow chart of method 400 of calling an elevator 204, in accordance with an embodiment of the disclosure. At block 404, the door lock 510 detects at least one status parameter 602, 604 of a door 205 and the door lock 510 operably associated with the door 205. As discussed above, the status parameters 602, 604 may comprise a door status parameter 602 depicting whether the door 205 is open or closed and a lock 604 status parameter depicting whether the door lock 510 is engaged or disengaged. In an embodiment, the door status parameter 604 may further depict a period of time that the door 205 is opened or closed. In another embodiment, the lock status parameter 604 further depicts a period of time that the door lock 510 is engaged or disengaged. At block 406 the door lock 510 transmits the at least one status parameter 602, 604 to a remote device 306. As mentioned above, in an embodiment, the remote device 306 may be the user mobile device 208.

At block 408, the remote device 306 determines whether to call an elevator 204 in response to the at least one status parameter 602, 604. The determination whether to call an elevator 204 may be verified. In the example where the remote device 306 is a user mobile device 208 the determination may be verified by detecting a distance parameter between the user mobile device 208 and the door lock 510. For example, if the distance parameter shows that the user mobile device 208 is moving away from the door lock 510 and/or towards the elevator bank then the determination is verified. Also, in the example where the remote device 306 is a user mobile device 208 the determination may also be verified by detecting a motion parameter of the user mobile device. For example, if the motion parameter shows that the user mobile device 208 is moving then the determination may be verified. The motion parameter may be detected via an accelerometer in the user mobile device 208. Further, in the example where the remote device 306 is a user mobile device 208 the determination may also be verified by the user mobile device 208 generating a pop-up through a user interface on the user mobile device 208. In non-limiting example, the pop-up may ask the user if they are heading to the elevator bank and request the user to select "yes" or "no" on the user interface. Once the user input is received then the determination is verified or disproved. In another non-limiting example, the pop-up may additionally ask the user for their destination floor. At block 410 the remote device 306 transmits an elevator call request 608 to a controller 206 when it is determined to call an elevator 204. At block 412, the controller 206 moves an elevator 204 to a floor where the door lock 510 is located. If the user had also indicated their destination, the elevator destination could already be preselected by the controller 206 based upon the call request 608.

The method 400 may also include that the remote device 306 determines an estimated time of arrival 610 in response to the at least one status parameter 602, 604 and the controller 206 adjusts movement of the elevator 204 in response to the estimated time of arrival 610. As discussed above, the estimated time of arrival 610 is the approximate time that a person leaving the door lock 510 will take to get to the elevator bank. Once the estimated time of arrival 610 is known then the control 206 ensure that the elevator 204 is at the elevator bank when the person arrives. In an example, the remote device 306 may determine the estimated time of arrival 610 based on estimated walking time. In the case where the remote device 306 is a user mobile device 208, the user mobile device 208 may adjust the estimated time of arrival 610 in response to feedback received from an accelerometer located in the user mobile device 208. The accelerometer may detect the speed that a person carrying the user mobile device 208 is walking and if they may have stopped. The estimated time of arrival 610 may update based on the location of the user mobile device 208. As described above, the location of the user mobile device 208 may be determined based on communication between the user mobile device 208 and one or more door locks 510. Alternatively, the user mobile device 208 may also determine its own location based on its own systems such as, for example, GPS, and cellular data.

While the above description has described the flow process of FIG. 4 in a particular order, it should be appreciated that unless otherwise specifically required in the attached claims that the ordering of the steps may be varied.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The term "about" is intended to include the degree of error associated with measurement of the particular quantity based upon the equipment available at the time of filing the application. For example, "about" can include a range of +8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of calling an elevator, the method comprising:

detecting, using a door lock, at least one status parameter of a door and the door lock operably associated with the door;

transmitting, using the door lock, the at least one status parameter to a remote device;

determining, using the remote device, whether to call an elevator in response to the at least one status parameter;

transmitting, using the remote device, an elevator call request to a controller when it is determined to call an elevator;

moving, using the controller, an elevator to a floor where the door lock is located;

detecting a distance parameter between the remote device and the door lock;

determining an estimated time of arrival in response to the at least one status parameter and distance parameter; and adjusting movement of the elevator in response to the estimated time of arrival.

2. The method of claim 1, wherein:

the at least one status parameter comprises:

a door status parameter depicting whether the door is open or closed; and a lock status parameter depicting whether the door lock is engaged or disengaged.

3. The method of claim 2, wherein:

the door status parameter further depicts a period of time that the door is opened or closed; and the lock status parameter further depicts a period of time that the door lock is engaged or disengaged.

4. The method of claim 1, wherein:

the remote device is a user mobile device.

5. The method of claim 4, wherein:

the at least one status parameter comprises:

a door status parameter depicting whether the door is open or closed; and a lock status parameter depicting whether the door lock is engaged or disengaged.

6. The method of claim 5, wherein:

the door status parameter further depicts a period of time that the door is opened or closed; and the lock status parameter further depicts a period of time that the door lock is engaged or disengaged.

7. The method of claim 4, further comprising:

detecting a motion parameter of the user mobile device; and verifying the determination to call an elevator in response to the motion parameter.

8. The method of claim 7, further comprising:

determining an estimated time of arrival in response to the at least one status parameter and motion parameter; and adjusting movement of the elevator in response to the estimated time of arrival.

9. The method of claim 4, further comprising:

generating a pop-up through a user interface on the user mobile device when the user mobile device determines to call elevator;

receiving a user input through the user interface; and verifying the determination to call an elevator in response to the user input.

10. The method of claim 1, wherein:

the remote device is a second door lock.

11. The method of claim 1, further comprising:

determining, using the remote device, a destination floor for the elevator, wherein destination floor is determined in response to at least one of a previous elevator call request, a time-of-day, and a selected schedule; and transmitting, using the remote device, the destination floor to the elevator.

12. An elevator call system comprising:

a remote device application in communication with a door lock, the remote device application configured to:

receive at least one status parameter from the door lock;

determine whether to transmit an elevator call request in response to the at least one status parameter; and a controller in communication with the remote device application, the controller configured to:

receive an elevator call request when it is determined to call an elevator;

move the elevator to a floor where the door lock is located; wherein the remote device application is configured to:

detect a distance parameter between the remote device and the door lock;

determine an estimated time of arrival in response to the at least one status parameter and distance parameter; and adjust movement of the elevator in response to the estimated time of arrival.

13. The elevator call system of claim 12, wherein:

the at least one status parameter comprises:

a door status parameter depicting whether the door is open or closed; and a lock status parameter depicting whether the door lock is engaged or disengaged.

14. The elevator call system of claim 13, wherein:

the door status parameter further depicts a period of time that the door is opened or closed; and the lock status parameter further depicts a period of time that the door lock is engaged or disengaged.

15. The elevator call system of claim 12, wherein:

the remote device is on a user mobile device.

16. The elevator call system of claim 15, wherein:

the at least one status parameter comprises:

a door status parameter depicting whether the door is open or closed; and a lock status parameter depicting whether the door lock is engaged or disengaged.

* * * * *